US009555643B2

(12) United States Patent
Aihara

(10) Patent No.: US 9,555,643 B2
(45) Date of Patent: Jan. 31, 2017

(54) TRANSFER DEVICE

(71) Applicant: Yuichi Aihara, Yamanashi-ken (JP)

(72) Inventor: Yuichi Aihara, Yamanashi-ken (JP)

(73) Assignee: NISCA CORPORATION, Minamikoma-Gun, Yamanachi-Ken (JP)

( * ) Notice: Subject to any disclaimer, the term of this patent is extended or adjusted under 35 U.S.C. 154(b) by 0 days.

(21) Appl. No.: 14/949,131

(22) Filed: Nov. 23, 2015

(65) Prior Publication Data

US 2016/0185125 A1 Jun. 30, 2016

(30) Foreign Application Priority Data

Dec. 26, 2014 (JP) ..... 2014-266142

(51) Int. Cl.
*B41J 2/325* (2006.01)

(52) U.S. Cl.
CPC ..... *B41J 2/325* (2013.01)

(58) Field of Classification Search
CPC ..... B41M 5/38207; B41J 2/325
See application file for complete search history.

(56) References Cited

U.S. PATENT DOCUMENTS 6,674,979 B2 * 1/2004 Nagano ..... G03G 15/2064 399/16

FOREIGN PATENT DOCUMENTS

JP 2014-162072 A 9/2014

* cited by examiner

*Primary Examiner* — Sarah Al Hashimi
(74) *Attorney, Agent, or Firm* — Manabu Kanesaka

(57) ABSTRACT

The present invention is to eliminate loosening of a transfer film on a rear end side of a card caused due to collision of a front end of the card against a conveying roller pair provided downstream of a transfer roller to prevent wrinkles from occurring in a transferred image. A rotation amount of a card conveying motor SMr and a wind amount of a transfer film 46 (conveying amount of the transfer film) are compared after a front end of a card K rushes into a conveying roller pair 37 during transfer processing for the card K to thereby detect a slip amount of the card K. A card conveying speed and a transfer film feed speed are controlled in accordance with the detected slip amount so as to eliminate loosening of the transfer film 46.

7 Claims, 12 Drawing Sheets

FIG. 10

| Environmental temperature | Preheating region | Preheating time |
|---|---|---|
| Extremely low temperature | Wide | Long |
| Low temperature | Only front end portion | Short |
| Room temperature or more | Not preheated | Not preheated |

TRANSFER DEVICE

BACKGROUND OF THE INVENTION

Field of the Invention

The present invention relates to a transfer device that transfers an image on a transfer film to a recording medium such as a card.

Description of the Related Art

Devices of this type are generally widely known as devices that form an image such as a face photo or text information on a medium such as a plastic card. Such devices have a configuration that forms an image directly on a recording medium or a configuration that forms an image once on a transfer film and then transfers the image on a recording medium.

There is known a card forming device that transfers a transfer protective film ribbon (film) to such a card. This device is of an indirect transfer type that uses a thermal head to form an image on a transfer film through an ink ribbon (primary transfer) and then uses a transfer roller to transfer the image formed on the transfer film to a recording medium such as a card (secondary transfer) (see, for example, Patent Document 1 [Jpn. Pat. Appln. Laid-Open Publication No. 2014-162072]). Further, there is also known a configuration of a laminator device that does not perform the primary transfer. This device transfers an image that has already been formed on a transfer film to a recording medium using a transfer roller.

PRIOR ART DOCUMENT

Patent Document

[Patent Document 1] Jpn. Pat. Appln. Laid-Open Publication No. 2014-162072

SUMMARY OF THE INVENTION

In Patent Document 1, when secondary transfer is performed using the transfer roller, the transfer film is loosened at a card rear end side so as to prevent a transfer image from being elongated due to back tension of the transfer film. The card that has been subjected to image transfer by the transfer roller is passed to a downstream-side conveying roller pair and conveyed downward thereby.

In this case, when a front end of the card enters between the downstream-side conveying roller pair, the card may slip between the transfer roller and a transfer platen that nip the card therebetween to prevent the card from advancing, with the result that the transfer film is loosened at the card rear end side more than expected. When the transfer processing is continued in this state, wrinkles may be caused in the transfer image.

Further, in a device that performs transfer processing while applying back tension, not the transfer device that performs transfer processing while loosening the transfer film at the card rear end side as disclosed in Patent Document 1, the following disadvantage may occur. That is, when the loosening of the transfer film is caused due to entering into of the card front end, an amount of the back tension may be changed to degrade quality of the transfer image. In any case, when excessive loosening is caused at the card rear end, the quality of the transfer image may be degraded.

To achieve the above object, according to a first aspect of the present invention, there is provided a transfer device that transfers, on a recording medium, an image on a transfer film which is formed by pressure contact between a heating member and a transfer platen through the transfer film, the device including: an image transfer section having the heating member and the transfer platen, in which the heating member and the transfer platen are configured to be movable between an actuation position at which they are brought into pressure contact with each other and a retracted position at which they are separated from each other; a plurality of recording medium conveyors that convey the recording medium; a first detector that detects a drive amount of one of the recording medium conveyors during the transfer processing; a transfer film feeder that feeds, during the image transfer, the transfer film on an upstream side relative to the heating member in a transfer film conveying direction; a transfer film conveyor that feeds, during the image transfer, the transfer film on a downstream side relative to the heating member in a transfer film conveying direction; a second detector that detects a transfer film conveying amount by the transfer film conveyor during the transfer processing; and a controller that controls the image transfer section, the recording medium conveyors, the transfer film feeder, and the transfer film conveyor. At least one of the recording medium conveyors is provided downstream of the heating member in the transfer direction. After a front end of the recording medium reaches the recording medium conveyor provided downstream of the heating member, the controller increases the conveying amount of the recording medium and/or reduces the transfer film feed amount in accordance with detection results of the first and second detectors.

Further, according to a second aspect of the present invention, there is provided a transfer device that transfers, on a recording medium, an image on a transfer film which is formed by pressure contact between a heating member and a transfer platen through the transfer film, the device including: an image transfer section having the heating member and the transfer platen, in which the heating member and the transfer platen are configured to be movable between an actuation position at which they are brought into pressure-contact with each other and a retracted position at which they are separated from each other; a plurality of recording medium conveyors that convey the recording medium; a transfer film feeder that feeds, during the image transfer, the transfer film on an upstream side relative to the heating member in a transfer film conveying direction; a film feed amount detector that detects a transfer film feed amount by the transfer film feeder during the transfer processing; a transfer film conveyor that feeds, during the image transfer, the transfer film on a downstream side relative to the heating member in a transfer film conveying direction; a film conveying amount detector that detects a transfer film conveying amount by the transfer film conveyor during the transfer processing; and a controller that controls the image transfer section, the recording medium conveyor, the transfer film feeder, and the transfer film conveyor. At least one of the recording medium conveyors is provided downstream of the heating member in the transfer direction. After a front end of the recording medium reaches the recording medium conveyor provided downstream of the heating member, the controller increases the conveying amount of the recording medium and/or reduces the transfer film feed amount in accordance with detection results of the film feed amount detector and the film conveying amount detector.

In the present invention, the slip amount of the recording medium generated when the recording medium rushes into the conveying member downstream of the heating member is detected, and the recording medium conveying speed is increased by the detected slip amount relative to the transfer film feed speed by the transfer film feeder, whereby the transfer film is not loosened excessively on the recording medium rear end side (transfer direction upstream side relative to the transfer roller). As a result, it is possible to prevent wrinkles and the like from occurring in a transferred image, thereby improving transfer quality.

BRIEF DESCRIPTION OF THE DRAWINGS

FIGS. 4A and 4B are views each for explaining principle of image transfer, in which FIG. 4A illustrates a state where a transfer member, a peeling member, and the support member are situated at their actuation positions, and FIG. 4B illustrates a state where they are situated at their retracted positions;

FIG. 10 is a table illustrating criteria of card preheating and details of preheating;

DESCRIPTION OF THE PREFERRED EMBODIMENTS

Figure 1:
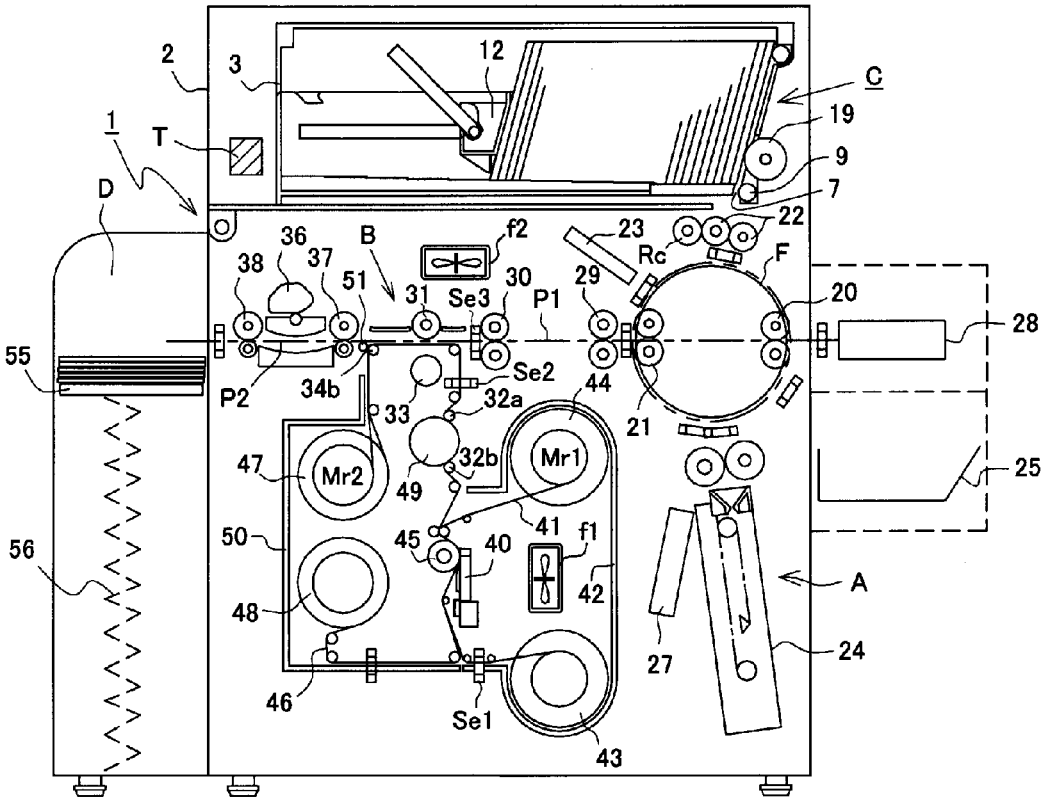
FIG. 1 is an explanatory view of an entire configuration of an information recording apparatus according to the present invention.

Hereinafter, the present invention will be described in detail based on an illustrated preferred embodiment. FIG. 1 is an explanatory view of an entire configuration of an information recording apparatus according to the present invention. The apparatus of FIG. 1 is configured to record image information onto an ID card for various certification purposes or a credit card for commercial transactions. To this end, the apparatus is provided with an information recording section A, an image recording section (image forming section) B, and a card supply section C for supplying a card to the information recording section A and the image recording section B.

[Card Supply Section]

The card supply section C is provided in an apparatus housing 1 and formed as a card cassette that houses a plurality of cards. A card cassette 3 illustrated in FIG. 1 houses the plurality of cards such that they are arranged in an array in a standing posture and delivers the cards rightward in FIG. 1. A separation opening 7 is provided at a leading end of the card cassette 3, and the cards are supplied inside the apparatus by a pickup roller 19 from the foremost card.

[Configuration of Information Recording Section]

A card K (recording medium) supplied from the above-mentioned card cassette 3 is fed to a reversing unit F through a conveying roller 22. The reversing unit F is constituted by a unit frame turnably bearing-supported by an apparatus frame (not illustrated) and a pair of or a plurality of pairs of rollers supported by the unit frame.

The reversing unit F of the illustrated example has a configuration in which two roller pairs 20 and 21 disposed spaced apart in a front-rear direction from each other are rotatably axially supported by the unit frame. The unit frame is configured to turn in a predetermined angle direction by a turning motor (pulse motor, etc.), and the roller pairs fitted to the unit frame are configured to rotate in both normal and reverse rotation directions by a conveying motor. Although not illustrated, a drive mechanism for the unit frame and the roller pairs may be configured such that the turning motion of the unit frame and rotation of the roller pairs are driven by a single pulse motor and switched by a clutch, or such that the turning motion of the unit frame and rotation of the roller pairs are driven independently of each other.

Accordingly, the cards prepared in the card cassette 3 are separated one from another by the pickup roller 19 and separation roller (idle roller) 9 to be fed to the downstream-side reversing unit F. Then, the reversing unit F carries the card in the unit by the roller pairs 20 and 21 and changes posture of the card in a predetermined angle direction with the card nipped by the roller pairs.

Around the reversing unit F in the turning direction thereof, there are disposed a magnetic recording unit 24, a non-contact type IC recording unit 23, a contact type IC recording unit 27, and a reject stacker 25. A reference numeral 28 illustrated in FIG. 1 denotes a barcode reader. The barcode reader 28 is a unit to read a barcode printed in the image forming section B to be described later for error check. Hereinafter, these recording units are referred to as data recording units.

Then, when the card that is posture-changed in the predetermined angle direction in the reversing unit F is fed to the recording unit by the roller pairs 20 and 21, it is possible to input data to the card magnetically or electrically. When a recording mistake occurs in the data input units, the card is carried out to the reject stacker 25.

The image forming section B is provided on the downstream side of the reversing unit F, a carry-in path P1 for carrying the card from the card cassette 3 to the image forming section B is provided, and the reversing unit F as described previously is disposed in the path P1. Further, in the carry-in path P1, there are disposed conveying rollers (that may be belts) 29 and 30 that convey the card, and the rollers 29 and 30 are coupled to a card conveying motor SMr (stepping motor). The conveying rollers 29 and 30 are configured to enable switching between normal rotation and reverse rotation and to convey the card from the image forming section B to the reversing unit F as well as from the reversing unit F to the image forming section B.

On the downstream side of the image forming section B, there is provided a carry-out path P2 for carrying the card to a storage stacker 55. In the carry-out path P2, there are disposed conveying rollers (that may be belts) 37 and 38 that convey the card, and the rollers 37 and 38 are coupled to the card conveying motor SMr (stepping motor) as described above.

In addition, a decurl mechanism 36 is disposed between the conveying rollers 37 and 38. The decurl mechanism 36 presses a card center portion held between the conveying rollers 37 and 38 to correct curl. To this end, the decurl mechanism 36 is configured to be able to shift to positions in the vertical direction in FIG. 1 by a not illustrated elevation mechanism (cam, etc.).

[Image Forming Section]

The image forming section B forms images such as a face photo and text data on the front and back sides of the card. The image forming section B is provided with a transfer platen 31. The transfer platen 31 forms the image on the card surface on the platen. In the illustrated apparatus, the image is formed on a transfer film 46 (intermediate transfer film), and the image on the film is transferred to the card surface on the transfer platen 31. To this end, the apparatus housing 1 is installed with an ink ribbon cassette 42 and a transfer film cassette 50.

The illustrated ink ribbon cassette 42 is detachably installed in the apparatus housing 1 with a thermal transfer ink ribbon 41 such as a sublimation ink ribbon and others wound between a feed roll 43 and a wind roll 44. The wind roll 44 is coupled to a wind motor (DC motor) Mr1, and the feed roll 43 is also coupled to a not illustrated DC motor. Further, on the apparatus side, there are disposed a thermal head 40 and an image forming platen 45 with the ink ribbon 41 therebetween.

An IC 74*a* for head control (see FIG. 6) is coupled to the thermal head 40 to thermally control the thermal head 40. The IC 74*a* for head control heats and controls the thermal head 40 according to image data to thereby form an image on the transfer film 46 to be described later with the ink ribbon 41. To this end, the wind roll 44 is configured to rotate in synchronization with the thermal control of the thermal head 40 to wind the ink ribbon 41 at a predetermined speed. A reference numeral "f1" in FIG. 1 denotes a cooling fan to cool the thermal head 40.

Meanwhile, the transfer film cassette 50 (hereinafter, referred to as a "film cassette") is also detachably installed in the apparatus housing 1. The transfer film 46 loaded in the film cassette 50 travels between the platen roller (image forming platen) 45 and the ink ribbon 41 to thereby form an image on the transfer film. To this end, the transfer film 46 is wound around a supply spool 47 and a wind spool 48 and feeds the image formed on the image forming platen 45 to between the transfer platen 31 and a transfer roller 33 to be described later. A reference numeral "49" illustrated in FIG. 1 denotes a feed roller for the transfer film 46. There are disposed, on the periphery of the feed roller 49, pinch rollers 32*a* and 32*b*. The feed roller 49 is coupled to a not illustrated drive motor (stepping motor). Further, the supply spool 47 is coupled to a DC motor Mr2, and the wind spool 48 is also coupled to a not illustrated DC motor.

Further, a reference numeral "34*a*" illustrated in FIG. 1 denotes a guide roller that guides the transfer film 46 to the transfer platen 31. A reference numeral "34*b*" illustrated in FIG. 1 denotes a peeling roller (peeling member) that peels off the transfer film 46 from the recording medium. The guide roller 34*a* and the peeling roller 34*b* are attached to the film cassette 50 and are positioned on the upstream side and downstream side, respectively, with the transfer platen 31 therebetween. A support pin 51 (support member) that supports the transfer surface side of the card is provided immediately on the downstream side of the peeling roller in the card conveying direction at the transfer processing time. The support pin 51 is provided in a bracket 69 that supports the peeling roller 34*b*. The peeling roller 34*b* and the support pin 51 maintain a certain positional relationship. Further, a distance L1 between the guide roller 34*a* and the peeling roller 34*b* is set to be smaller than a length Lc of the card K in the image forming direction (conveying direction) (L1<Lc).

The transfer roller 33 is disposed opposite to the transfer platen 31 with the transfer film 46 therebetween. The transfer roller 33 brings the image formed on the transfer film 46 into thermal pressure contact with the card for image transfer. To this end, the transfer roller 33 includes a heat roller and is provided with a transfer member elevation means 61 to be described later, to come into press-contact with and separate from the transfer platen 31 from inside the film cassette 50. The transfer platen 31 is driven by the same conveying motor SMr (stepping motor) as that for the conveying rollers 29, 30, 37 and 38, and performs transfer processing while conveying the card K (and the intermediate transfer film 46) with the card K and the intermediate transfer film 46 nipped by the platen 31 and the transfer roller 33. A reference numeral "Se1" illustrated in FIG. 1 denotes a position detection sensor for the ink ribbon 41, a reference numeral "Se2" denotes a sensor for detecting presence/absence of the transfer film 46. A fan f2 to remove heat generated inside the apparatus to the outside is provided in the image forming section B. Thus, the unit for forming an image on the intermediate transfer film 46 using the thermal head 40 is referred to as a primary transfer section, and the unit for transferring the image formed on the intermediate transfer film 46 in the primary transfer section to the card K is referred to as a secondary transfer section.

A card storage section D is provided on the downstream side of the image forming section B, and cards fed from the transfer platen 31 are stored in the storage stacker 55. The storage stacker 55 is configured to be lowered in accordance with the card storage amount with an elevation mechanism 56 and a not illustrated level sensor.

[Configuration of Film Cassette]

Figure 2:
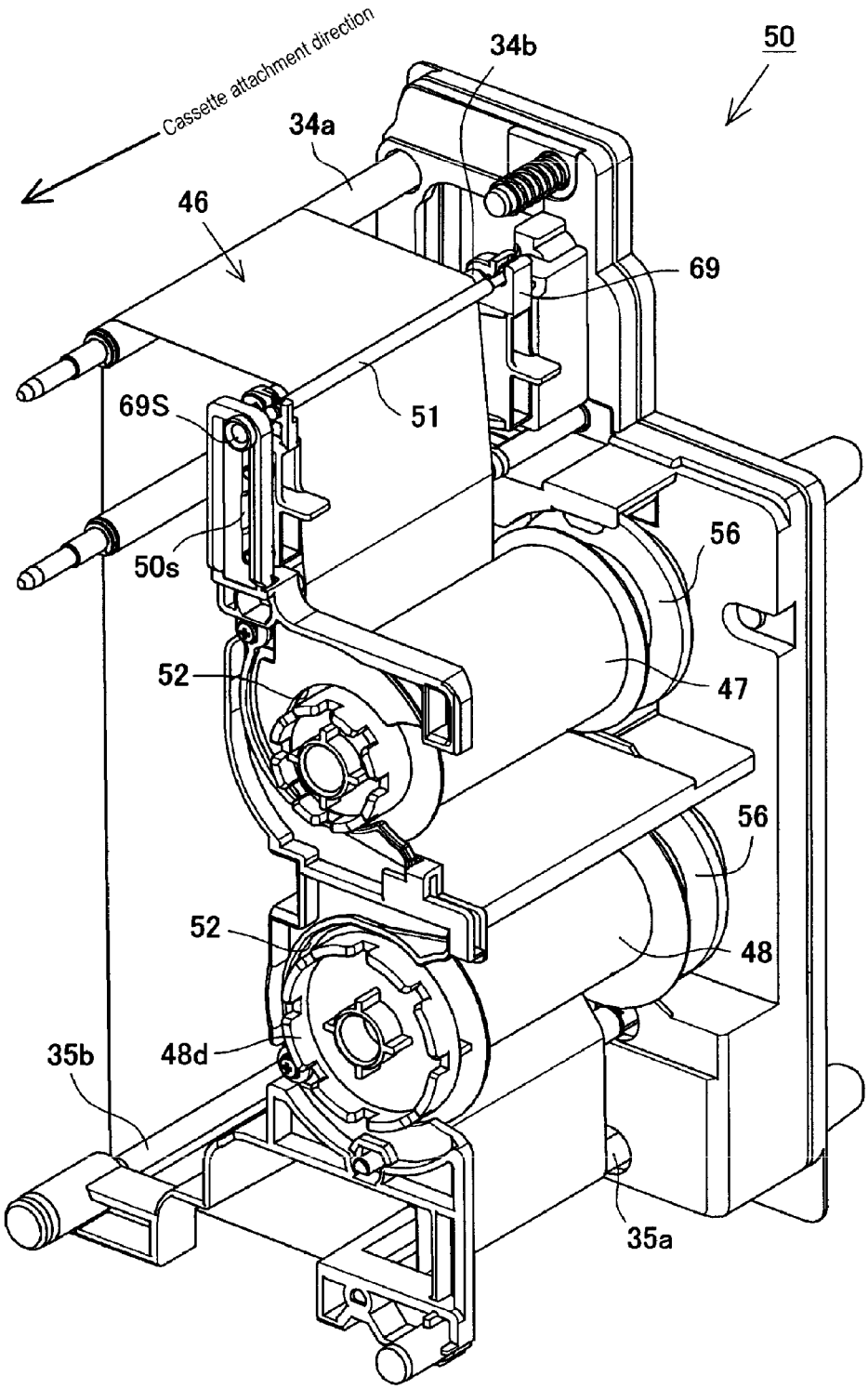
FIG. 2 is a perspective view of a film cassette in the apparatus of FIG. 1.

The following describes the film cassette 50 loaded with the transfer film 46 described above. As illustrated in FIG. 2, the film cassette 50 is made of a unit separated from the apparatus housing 1 and is detachably attached to the apparatus housing 1. Although not illustrated, a front cover is disposed so as to be openable and closable on the front side in FIG. 1, and the film cassette 50 is inserted in the apparatus frame in the arrow direction in FIG. 2 with the front cover opened.

The film cassette 50 is detachably installed with the supply spool 47 and the wind spool 48. A reference numeral "52" illustrated in FIG. 2 is a bearing portion that supports one end of the spool, and a reference numeral "56" illustrated in FIG. 2 is a coupling member that supports the other end side of the spool. The spool end portions are supported, respectively, by the bearing portion 52 and the coupling member 56 disposed on the cassette side. The transfer film 46 is laid from the supply spool 47 to guide rollers 34*a*, 35*b*, 35*a* and the wind spool 48 through the peeling roller 34*b*.

The guide rollers 35*a*, 35*b*, 34*a* and the peeling roller 34*b* (peeling member) illustrated in FIG. 2 are each formed from a pin member (driven roller) attached to the film cassette 50; alternatively, however, these rollers may be fixed pins (non-rotation). In the apparatus, in transferring the image on the transfer film 46 to the card, transfer is performed while winding the transfer film 46 by the supply spool 47. Accordingly, the peeling roller 34*b* is provided on the downstream side (on the side closer to the supply spool 47 than the transfer roller 33) in the film conveying direction during the transfer of the transfer film 46.

The peeling roller 34*b* is fixed to the bracket 69, and the bracket 69 is provided with the support pin 51. The transfer film 46 travels between the peeling roller 34*b* and the support pin 51 and, thus, in replacing the transfer film 46 with new one, the support pin 51 is separated from the peeling roller 34*b* with the film cassette 50 removed from the apparatus housing 1.

Figure 3:
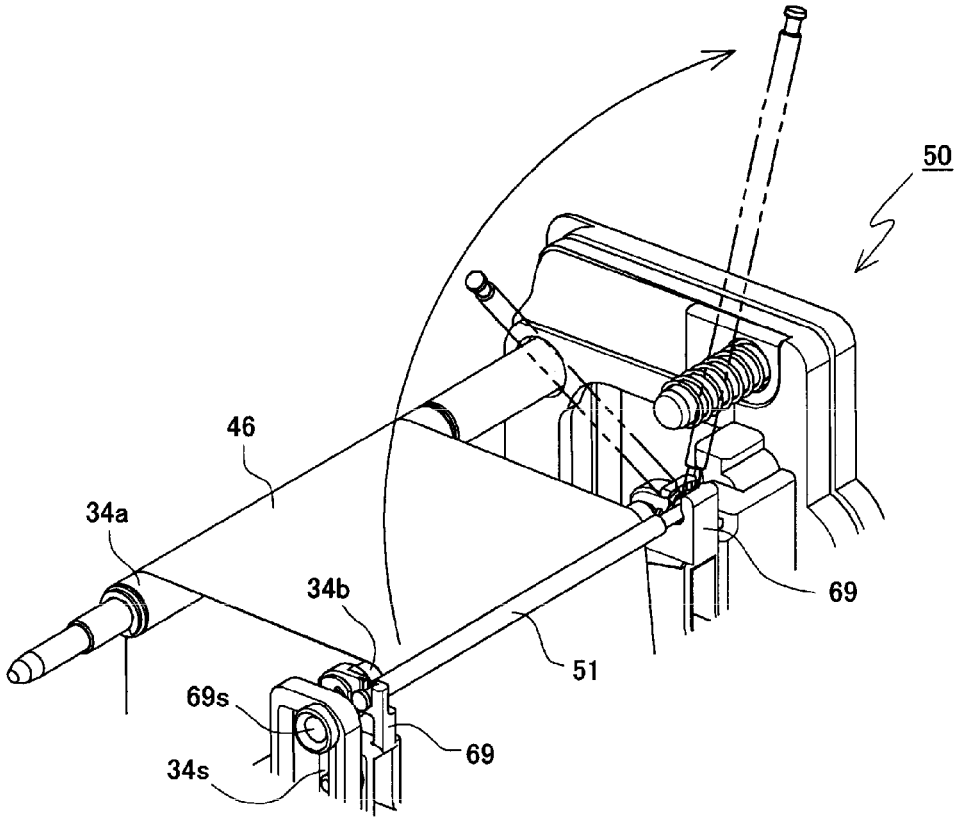
FIG. 3 is an enlarged view of a support member in the film cassette of FIG. 2.

As illustrated in FIG. 3, one end 51*a* of the support pin is detachably fitted into the bracket 69, and the other end 51*b* is pivotably supported by a concave portion of the bracket 69. Thus, the support pin 51 is configured to be pivotable in an arrow direction in FIG. 3. Accordingly, the support pin 51 can move (pivot) to a set position (continuous line) and a release position (long dashed double-short dashed line). A user removes the film cassette 50 from the apparatus housing 1, replaces the transfer film 46 with new one with the support pin 51 moved to the release position, and after returning the support pin 51 to the set position, loads the film cassette 50 into the apparatus housing 1.

Figure 4A:
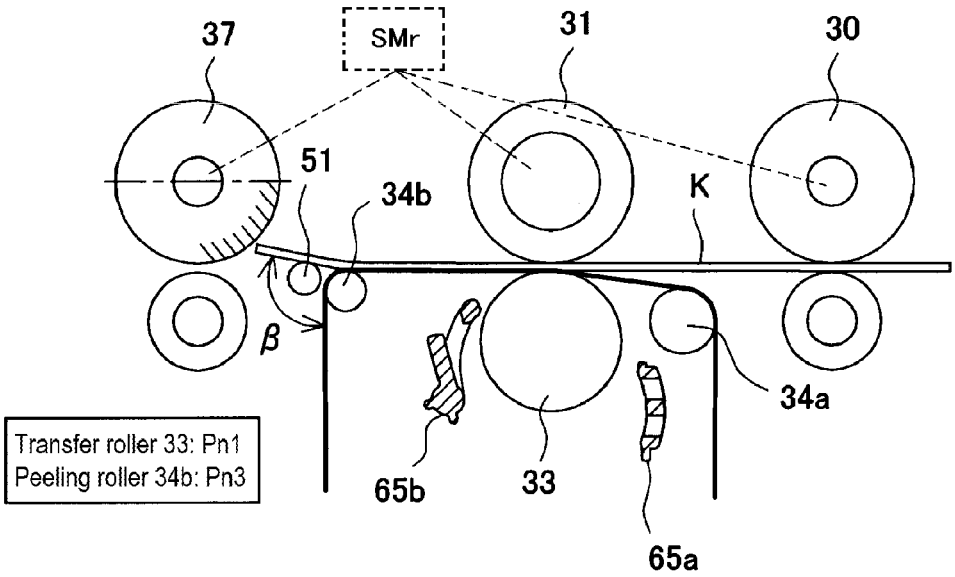

The support pin 51 needs to maintain a certain positional relationship with the peeling roller 34*b* in a state where it is at the set position. As illustrated in FIG. 4A, in a state where the card front end is supported by the support pin 51 after the transfer film 46 is peeled off from the card K, a force is applied to the support pin 51 in the travel direction (downward in FIG. 4A) of the peeled transfer film 46. The bearing concave portion of the bracket 69 that supports the support pin 51 is provided in the direction along the travel direction of the transfer film 46, and the support pin 51 is supported on the bottom of the bearing concave portion in the set position, so that even when the force in the travel direction of the transfer film 46 is applied from the card K, the bracket 69 can securely support the support pin 51. As a matter of course, the support pin 51 may pivot in a direction crossing the transfer film travel direction, and it is necessary to maintain the set position so that the positional relationship with the peeling roller 34*b* is not changed when the support pin 51 supports the card K.

There are engaged, with the thus laid transfer film 46, the feed roller 49 and pinch rollers 32*a* and 32*b* which are disposed on the apparatus side. Not illustrated drive rotating shafts coupled to the supply spool 47 and the wind spool 48 and the feed roller 49 are driven into rotation to cause the film to travel at the same speed.

A detailed configuration of the secondary transfer section will be described herein according to FIGS. 4A and 4B. In the secondary transfer section, there are disposed the transfer roller (heat roller) 33, the transfer platen 31, the guide roller 34*a* that guides the transfer film 46, the peeling roller 34*b* that guides the transfer film 46 and peels off the transfer film 46 from the card K, and the support pin 51 that supports the transfer surface side of the card K on the downstream side of the peeling roller 34*b*. Further, provided are the conveying rollers 30 that convey the card K between the transfer roller 33 and the transfer platen 31 and the conveying rollers 37 that nip the card passing through the support pin 51 to convey the same to the downstream side. A distance between the conveying roller 30 and the conveying roller 37 is set to a distance smaller than the length Lc in the conveying direction of the card K so as to convey the card at the time of normal conveyance other than the transfer processing.

Figure 4B:
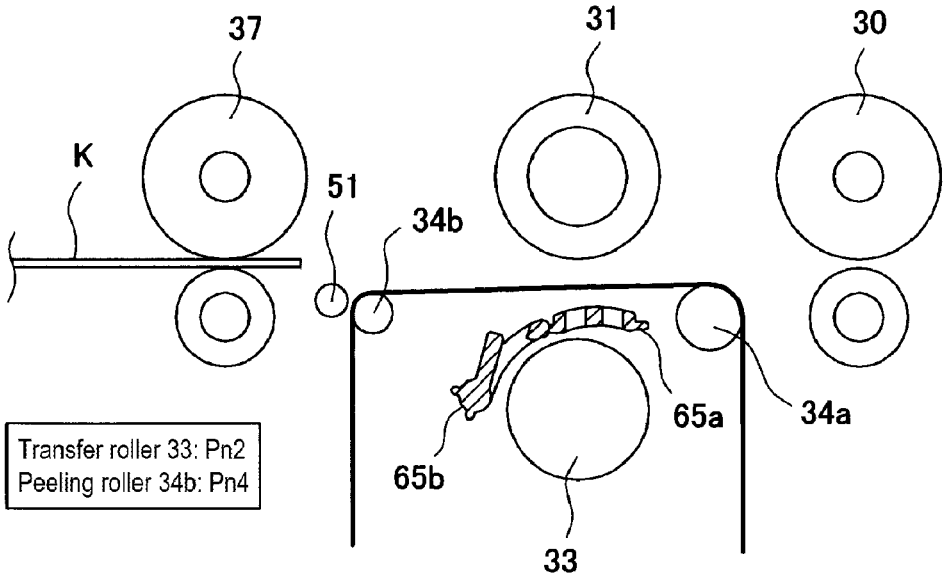
Figure 5:
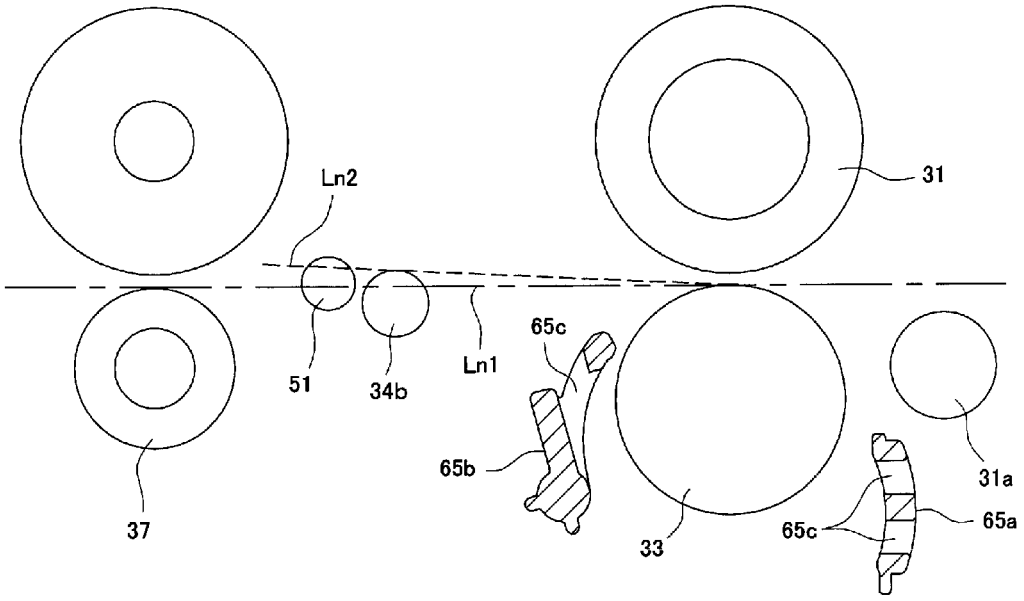
FIG. 5 is an enlarged view illustrating an arrangement relationship between the peeling member and the support member at their actuation positions.

The transfer roller 33, the peeling roller 34*b* and the support pin 51 are respectively configured to be movable to actuation positions illustrated in FIG. 4A and retracted positions illustrated in FIG. 4B. The peeling roller 34*b* is set so as to come into contact with the surface of the card K conveyed along the carry-in path P1 via the transfer film 46 at the actuation position. Accordingly, as illustrated in FIG. 5, a card contact point of the peeling roller 34*b* is offset at least to the transfer platen 31 side (card side) from a straight line Ln1 (first tangent passing through the card contact point of the transfer roller 33 and the card contact point of the conveying rollers 37) connecting the card contact point of the transfer roller 33 at the actuation position and card contact point at which the conveying rollers 37 contact the card transfer surface, and is not disposed on the transfer roller 33 side relative to the straight line Ln1. In the present embodiment, the card contact point of the peeling roller 34*b* is offset to the transfer platen side by 1.52 mm from the straight line Ln1. The card contact point of the peeling roller 34*b* is essentially required not to be on the transfer roller 33 side relative to the straight line Ln1 and may be set on the line of the straight line Ln1.

Accordingly, the transfer film 46 transferred to the card adheres to the card from the transfer roller 33 to the peeling roller 34*b* and is peeled off from the card surface when the card reaches the peeling roller 34*b*. The peeled transfer film 46 is wound in a direction (downward direction in FIGS. 4A and 4B) orthogonal to the card and, therefore, the relationship of approximately 90 degrees is kept between the card and the peeled transfer film 46 via the peeling roller 34*b* (peeling angle β is approximately 90 degrees).

As illustrated in FIG. 4A, the card passing through the peeling roller 34*b* is supported by the support pin 51 without the card front end being pulled in the travel direction of the transfer film 46 to change the posture downward. The card contact point of the support pin 51 is offset to the transfer platen 31 side (card side) from a straight line Ln2 (second tangent passing through the card contact point of the transfer roller 33 and card contact point of the peeling roller 34*b*) connecting the card contact point of the transfer roller 33 at the actuation position and card contact point of the peeling roller 34*b* at the actuation position and is not disposed on the transfer roller 33 side relative to the straight line Ln2. In the present embodiment, the card contact point of the support pin 51 is offset to the transfer platen side by 0.35 mm from the straight line Ln2. The card contact point of the support pin 51 is essentially required not to be on the transfer roller 33 side relative to the straight line Ln2 and may be set on the line of the straight line Ln2.

When the card contact point of the support pin 51 is disposed below the straight line Ln2, the card front end is pulled in the travel direction of the transfer film 46 as in the conventional case, so that the card contact point of the support pin 51 needs to be disposed at least on the straight line Ln2 or on the transfer platen 31 side relative to the straight line Ln2. However, when the contact point is offset to the transfer platen 31 side too much, a level difference between the support pin 51 and the peeling roller 34*b* becomes large to separate the peeling roller 34*b* from the card K, with the result that there occurs a risk of occurrence of a problem that the peeling position of the transfer film 46 becomes unstable. Thus, it is desirable to appropriately set the offset amount from the type of recording medium to handle or the like.

Further, when a distance from the peeling roller 34*b* to the support pin 51 is large, the time of the state where the card front end is not supported becomes long, so that it is desirable to place the support pin 51 just behind the peeling roller 34*b*. Accordingly, in the present embodiment, a diameter of the peeling roller 34*b* is 5 mm, a diameter of the support pin 51 is 3 mm, the distance between a center of the peeling roller 34*b* and a center of the support pin 51 is 5 mm and, therefore, a clearance between the peeling roller 34*b* and the support pin 51 is 1 mm. Thus, by making the support pin 51 thinner than the peeling roller 34*b*, it is possible to bring the support pin 51 close to the peeling roller 34*b*. However, when the support pin is made too thin, the strength to hold the card K is not kept, so that it is desirable to thin the support pin 51 with the strength left to some extent.

Furthermore, as described above, the peeling roller 34*b* and support pin 51 are supported by the same bracket 69 and, therefore, it is easy to position the peeling roller 34*b* and the support pin 51 in terms of height relationship. For example, the support pin 51 may be provided on the apparatus body side. In this case, it is necessary to move the support pin 51 on the apparatus body side and the peeling roller 34*b* on the film cassette 50 side to respective actuation positions and retracted positions, and it is further necessary to maintain the above-mentioned arrangement relationship when both the pin and the roller are in the actuation positions. Therefore, high part processing accuracy is required.

The card front end is slightly raised by the support pin 51 and, therefore, when the conveying rollers 37 downstream relative to the support pin 51 are disposed in a far position from the support pin 51, the card front end is not nipped by the conveying rollers 37. Accordingly, the conveying rollers 37 are disposed at a position where the card front end enters a lower-half region (oblique-line portion of the conveying roller 37 of FIG. 4A) of the upper conveying roller 37.

Further, the transfer roller 33 is configured to come into press-contact and separate with/from the transfer platen 31. A control means 70 to be described later moves the transfer roller 33 to the actuation position (Pn1) for press-contact with the card in transferring the image onto the card, and after image formation (after the card rear end passes through the transfer roller 33), moves the transfer roller 33 to the retracted position (Pn2) for separation from the card. With this configuration, the transfer film 46 is prevented from contacting the transfer roller (heat roller) 33 after the card rear end passes through the transfer roller 33 and from becoming deformed due to heat of the transfer roller 33.

Further, the control means 70 moves the peeling roller 34*b* and the support pin 51 from the actuation position (Pn3) to the retracted position (Pn4) at timing when the card rear end passes through the support pin 51. Herein, since the peeling roller 34*b* and the support pin 51 are moved to the retracted position, the card is prevented from colliding with the support pin 51 and the peeling roller 34*b* in switchback-conveying the card toward the reversing unit F on the upstream side in the conveying path in performing two-side printing. Such control eliminates a risk that the transfer film is acted upon by excessive heat and becomes deformed and, also, the occurrence of a transfer failure in peeling off the transfer film 46.

Therefore, in order to move the transfer roller 33, the peeling roller 34 and the support pin 51 up and down, the control means controls a not illustrated transfer member elevation means 61 and a not illustrated peeling member elevation means 62 (moving means). This control is to move the position of the transfer roller 33 from the retracted position (Pn2) to the actuation position (Pn1) at an estimated time of arrival of the card front end at the transfer platen 31. Further, in tandem therewith (for example, print command signal, job end signal on the upstream side or the like), the control means moves the peeling roller 34*b* and the support pin 51 from the retracted position (Pn4) to the actuation position (Pn3).

In this state, the image is transferred to the card moving to the platen position at a predetermined speed beginning with the front end to the rear end. At an estimated time of passing of the card rear end through the transfer roller 33, the transfer roller 33 is moved to the retracted position (Pn2). Then, the transfer film 46 is supported by the guide roller 34*a* and the peeling roller 34*b* with a part thereof beaten onto the card surface. Subsequently, with the moving of the card in the discharge direction, the transfer film 46 is peeled off gradually from the card surface. At this time, the card front end is supported by the support pin 51.

In this process of image transfer, the transfer film 46 is peeled off in the same angle direction from the card front end to the rear end at a certain peeling angle β with respect to the card surface. Accordingly, unevenness does not occur in the image transferred to the card.

In the present embodiment, as illustrated in FIG. 4A, the front end of the card K runs on the peeling roller 34*b* and the support pin 51 and rushes into the conveying roller pair 37 while abutting against the side surface of the upper conveying roller 37 (oblique-line portion of the conveying roller 37). At this time, a slippage (roller idle rotation) may occur between the transfer roller 33 and the transfer platen 31 that nip the card K and between the conveying roller pair 30 that also nip the card K. This reduces an actual conveying amount of the card K and, therefore, a conveying amount of an upstream part of the transfer film 46 relative to the transfer roller 33 becomes larger than the conveying amount of the card K (that is, only the transfer film 46 is fed while the card K does not advance), with the result that a loosening amount of the transfer film 46 is increased by about 1 mm.

When the card K slips, the card conveying motor SMr continues its driving, and the conveying rollers 30, 37 and transfer platen 31 continue their rotation; however, actually the conveyance of the card K is stopped and, accordingly, the conveyance of the transfer film 46 at the downstream side in the transfer direction is stopped (the transfer film 46 at the downstream side in the transfer direction is adhered to the card K and thus conveyed in one-to-one relation with the card K). Thus, by comparing a drive amount of the card conveying motor SMr (or rotation amount of the conveying roller) and conveying amount of the transfer film at the downstream side in the transfer direction (in the present embodiment, rotation amount of the supply spool 47), it is possible to detect how much the card K has slipped. Alternatively, also by comparing a drive amount (feed amount of the transfer film 46) of the drive motor (stepping motor) for the feed roller 49 in place of the drive amount of the card conveying motor SMr and winding amount (conveying amount) of the transfer film at the downstream side in the transfer direction, the slip amount of the card K can be detected.

Thus, in the present embodiment, the slip amount of the card K, that is, the loosening amount of the transfer film 46 at the upstream side in the transfer direction is detected and, based on the detected loosening amount, the card conveying speed (card conveying amount) is increased and/or transfer film feed speed (transfer film feed amount) by the feed roller 49 is reduced, whereby the loosening amount of the transfer film 46 is maintained in a certain range to improve stability of transfer quality.

Further, in the present embodiment, the feed amount of the transfer film 46 during transfer processing performed by an image transfer section is managed by the feed roller 49. When the conveying amount of the transfer film 46 fed by the feed roller 49 is smaller than that of the card K (and the transfer film 46) during the transfer processing, back tension of the transfer film 46 is excessively applied to a nip point of the card held between the transfer roller 33 and the transfer platen 31, the image to be transferred to the card K is elongated. In order to prevent this, during the transfer processing, the feed amount of the transfer film 46 is made larger than the conveying amount of the card K to loosen the transfer film 46 at the card rear end side. The card conveying amount is controlled by the card conveying motor SMr (stepping motor) connected to the conveying rollers 30, 37 and the transfer platen 31, and the feed amount of the transfer film 46 is controlled by the drive motor (stepping motor) connected to the feed roller 49. As a result, it is possible to prevent the image from being elongated due to the back tension of the transfer film 46.

However, if, after completion of the transfer processing, the transfer film 46 is loosened at the upstream side relative to the card rear end in peeling of the transfer film 46 from the card rear end, the transfer film 46 is not peeled off when the card rear end passes through the peeling roller 34*b*, and the peeling position is shifted downstream from the peeling roller 34*b*. Thus, a peel angle is changed, with the result that peel waste is generated at the card rear end side.

Thus, in the present embodiment, the conveying amount of the card K by the conveying roller pairs 37, 38 is increased during a time from when the card rear end passes through the transfer roller 33 to when it reaches the peeling roller 34*b* to eliminate the loosening of the transfer film 46 at the feed roller 49 side relative to the rear end of the card K. The loosening amount of the transfer film 46 is a sum of the loosening amount obtained as a result of the increase in the feed amount of the feed roller 49 and loosening amount obtained as a result of the above-mentioned slippage of the card K, and the conveying amount of the card K and feed amount of the transfer film 46 are controlled in accordance with the detected loosening amount. The adhesion surface between the card K and the transfer film 46 is high in temperature, so that when the back tension of the transfer film 46 is applied immediately after the card rear end passes through the transfer roller 33, the transfer film 46 is peeled off before the card rear end reaches the peeling roller 34*b*. That is, early peeling occurs to generate peel waste.

With the above configuration, the loosening amount of the transfer film 46 at the upstream side relative to the transfer roller 33 is set to an adequate value (about 2 mm). Thus, even if the loosening amount of the transfer film 46 is increased when the card front end rushes into the conveying roller pair 37 afterward, increasing, by the increase in the loosening amount, the conveying speed of the card K prevents the transfer film 46 from being loosened excessively and, further, reducing the feed amount of the transfer film 46 after the card rear end passes through the transfer roller 33 allows the loosening of the transfer film 46 to be eliminated upon peeling thereof from the card rear end, whereby satisfactory transfer and peeling can be achieved.

In the present embodiment, the conveying roller pair 37 constitutes a part of the decurl mechanism 36, and the rollers of the conveying roller pair 37 are slightly separated from each other when decurl processing of the card K is performed. Thus, a nip pressure between the conveying roller pair 37 with respect to the card K is set lower than a nip pressure between the transfer roller 33 and the transfer platen 31. After the card rear end passes through the transfer roller 33, the card K is conveyed only by the conveying roller pair 37, so that a slippage may occur between the conveying roller pair 37 with a low nip pressure and the card K. Thus, when the conveying amount of the card K is managed by the drive amount of the card conveying motor SMr (stepping motor) that drives the conveying roller pair 37 after the card rear end passes through the transfer roller 33, the actual conveying amount falls below the estimated conveying amount, with the result that the card K cannot be conveyed to a correct transfer end position in some cases.

Thus, in the present embodiment, focusing on a fact that the card K and the transfer film 46 are adhered to each other and conveyed together in a range from the transfer roller 33 to the peeling roller 34*b*, a control section H manages (counts) the conveying amount (winding amount) of the transfer film 46 as the card conveying amount during a time from when the transfer processing is started to when the card rear end passes through the peeling roller 34*b*. Specifically, the control section H acquires a rotation amount of the DC motor Mr2 that drives the supply spool 47 that winds the transfer film 46 upon secondary transfer by using an encoder mounted to a rotary shaft of the DC motor Mr2 and calculates the conveying amount of the transfer film 46 while referring to a diameter of the supply spool 47 at that time. That is, assuming that a distance between the transfer roller 33 and the peeling roller 34*b* is 74 mm, the control section H can grasp, from the diameter information of the supply spool 47 upon the secondary transfer, the number of rotations of the DC motor Mr2 required to convey the transfer film 46 by 74 mm and, when the number of rotations of the DC motor Mr2 reaches the required number, determines that the transfer film 46 has been conveyed by 74 mm. The conveying amount of the card K is calculated by counting the drive amount of the card conveying motor SMr after the card front end passes through a card sensor Se3.

The control section H manages (counts) the conveying amount of the card K based on the drive amount of the card conveying motor SMr that drives the transfer platen 31, conveying rollers 29, 30, 37, and 38 during a time from the start of the secondary transfer to when the card front end reaches the transfer roller 33 and after the card rear end passes through the peeling roller 34*b*. Thus, during one secondary transfer, the control section H switches the motor to be referred to for managing the conveying amount of the card K as follows: card conveying motor SMr (arbitrary timing during a time from the start of the transfer to when the card front end reaches the conveying roller 37 (from FIG. 7C to FIG. 8A))→DC motor Mr2 (during a time from when the card front end is positioned before the conveying roller 37 to when the card rear end passes through the peeling roller 34*b* (from FIG. 8A to FIG. 8C))→card conveying motor SMr (during a time from when the card rear end passes through the peeling roller 34*b* to card carry-out or reverse conveyance for back side transfer).

During a time from the start of the transfer (including feeding of the card to its cueing position) to when the card rear end reaches the transfer roller 33, the control section H manages the conveying amount of the card K by detecting the rotation amount of the card conveying motor SMr after the card front end passes through the sensor Se3. The timing at which the motor to be referred to for managing the card conveying amount is switched from the card conveying motor SMr to DC motor Mr2 may be arbitrary as long as it falls within a time during which the card front end is situated between the transfer roller 33 and the conveying roller 37.

When the secondary transfer is started, the card K and the transfer film 46 are nipped between the transfer roller 33 and the transfer platen 31. At this time, a part of the transfer film 46 on the downstream side relative to the transfer roller 33 is slightly loosened, so that when the transfer is actually started, the DC motor Mr2 is driven first, followed by the card conveying motor SMr, to start conveying the card K and the transfer film 46. Thus, the card conveying amount upon the transfer start is better to be managed by the card conveying motor SMr for conveying the card K. Afterword, the card K and the transfer film 46 are simultaneously conveyed in a one-to-one manner, so that it is preferable to switch the motor to be referred to for managing the card conveying amount at an arbitrary timing between when the card conveyance is started in the transfer processing and when the card front end reaches the conveying roller 37.

[Control Configuration]

Figure 6:
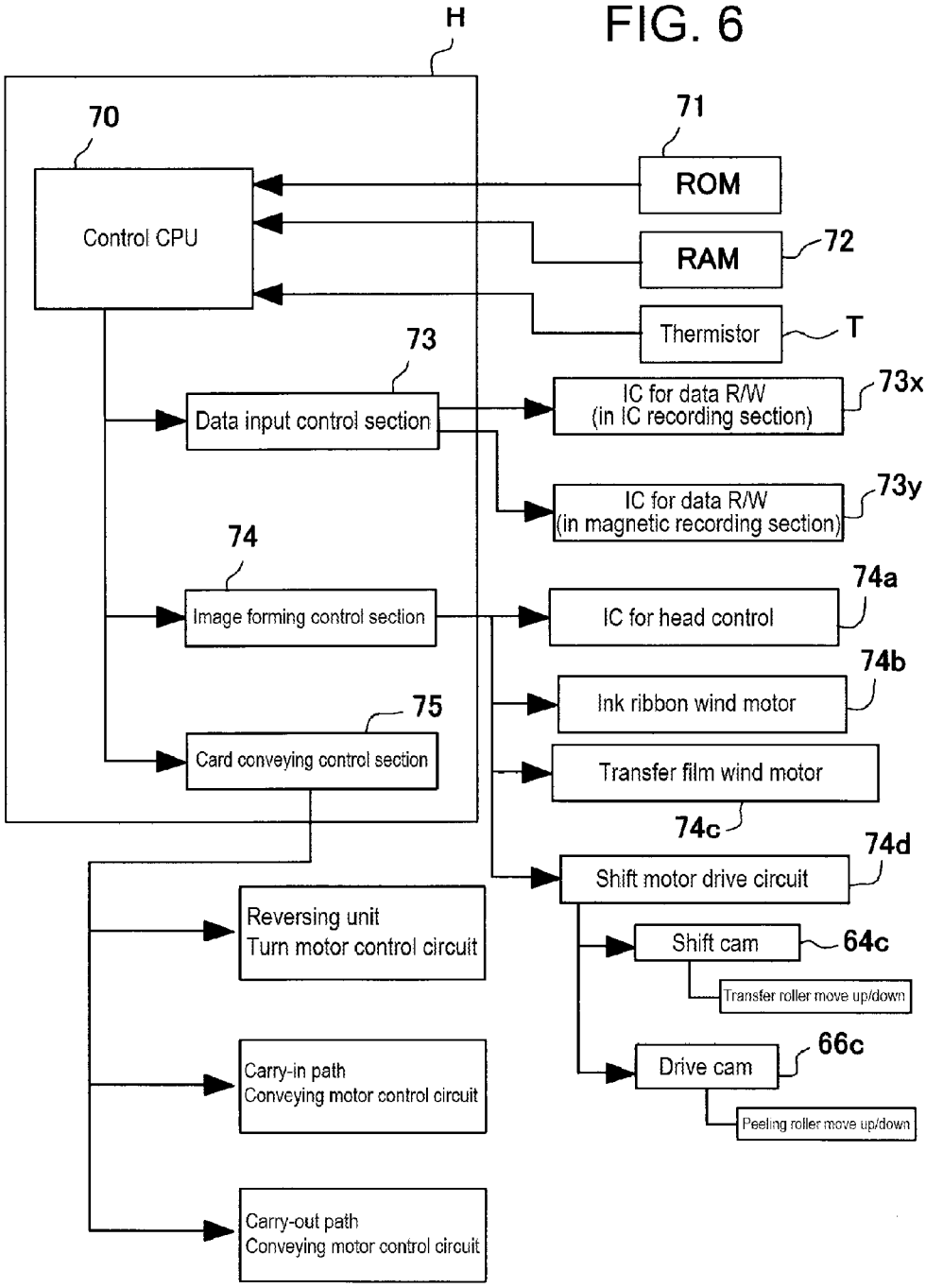
FIG. 6 is a control configuration view of the apparatus of FIG. 1.

A control configuration according to the present invention will be described with reference to FIG. 6. For example, the control section H is constituted by a control CPU 70, and the CPU 70 is provided with a ROM 71 and a RAM 72. In the control CPU 70, there are formed a data input control section 73, an image forming control section 74, and a card conveying control section 75. The card conveying control section 75 transmits a command signal to a drive circuit of a not illustrated drive motor so as to control a card conveying means (conveying roller pairs illustrated in FIG. 1) disposed in the carry-in path P1 and the carry-out path P2. The card conveying control section 75 transmits a command signal to a drive circuit of a turn motor of the reversing unit F. Further, the control CPU 70 detects an environmental temperature using the thermistor T and performs card conveying control for preheat using the card conveying control section 75.

The card conveying control section 75 is electrically connected to sensors Se1 to Se10 to receive respective state signals of the sensors. Further, the card conveying control section 75 is connected the data input control section 73 to receive a job signal therefrom.

The data input control section 73 is configured to transmit a command signal to control transmission/reception of input data to/from an IC 73*x* for data R/W built in a magnetic recording section A1 and similarly transmit a command signal to an IC 73*y* for data R/W in an IC recording section A2. The image forming control section 74 controls image formation on both the front and back sides of the card in the image forming section B.

In this image formation control, an image is transferred to the card surface with the transfer platen 31 in response to the conveyance of the card controlled in the card conveying control section 75. To this end, the image forming control section 74 is provided with an ink ribbon wind motor control section 74*b*, a transfer film wind motor control section 74*c*, and a shift motor MS control section 74*d* to form the image on the transfer film 46 with the image forming platen 45.

In the RAM 72, processing time to input data on the card in the data input section (magnetic/IC recording section) is stored, for example, in a data table. Further, the card conveying control section 75 is provided with a monitor means H1, and both are incorporated into control programs of the control CPU 70. The monitor means H1 is configured to receive the state signals of the sensor Se1 to Se10 and job signal from the data input control section 73 so as to monitor a conveying state of cards existing inside the apparatus.

Figure 9:
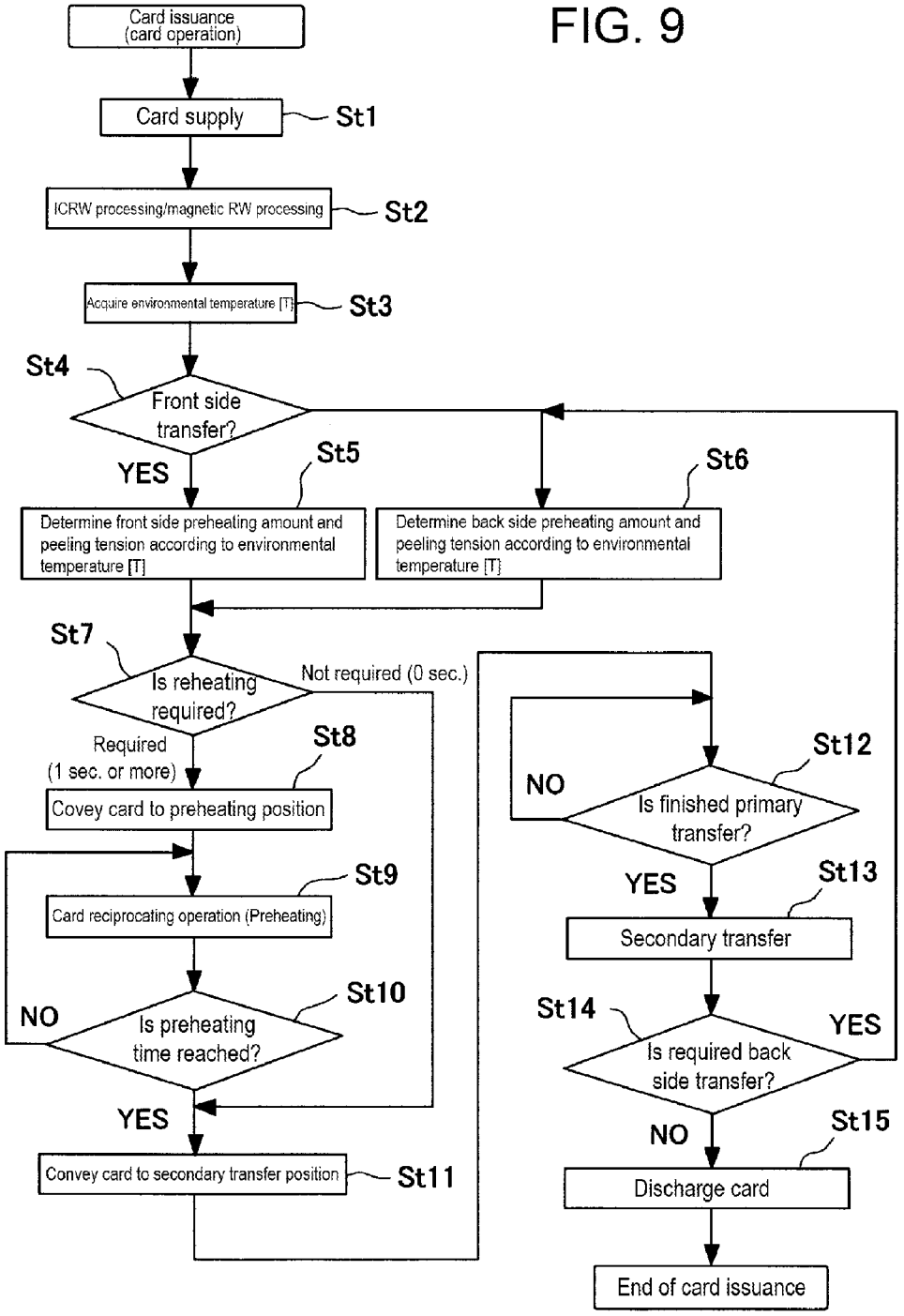
FIG. 9 is a flowchart concerning card issuance processing.

Herein, the entire operation of a card printing apparatus (information recording device) according to the present embodiment will be described according to motion of the card K (FIG. 9). First, upon receiving printing data and information recording data from a host apparatus such as a personal computer, the cards K are supplied to the reversing unit F one by one from the card supply section C (St1). At this time, the CPU 70 heats the transfer roller 33 and keeps the temperature in a state of about 185° C. Then, when there is the information recording data, the card K is conveyed to the information recording section A from the reversing unit F and undergoes information recording processing (St2). When there is no information recording data, the processing proceeds to preheating treatment to be described later.

At this time, in the primary transfer section of the image forming section B, by bringing the transfer film 46 and the ink ribbon 41 into pressure-contact with each other with the thermal head 40 and the platen roller 45 to heat them, an image is formed on the transfer film 46. At this time, to overlay each color of the ink ribbon 41 in an image formation region of the transfer film 46, the transfer film 46 is conveyed back and forth by the supply spool 47, the wind spool 48 and the feed roller 49.

The card K for which the information recording processing has been finished undergoes preheating treatment of the card front end during the primary transfer processing. First, the environmental temperature is detected with the thermistor T (St3). As a result, the extent to which the card is cold and the extent to which the card needs to be preheated are determined based on a table of FIG. 10. The environmental temperature is referred to also to determine a wind torque (peeling tension) by the supply spool 47 to peel off the transfer film 46 from the card K that has been subjected to transfer. Subsequently, it is determined whether the card surface to be image-transferred from now is the front or back side (St4). This is because the card temperature differs between the front side transfer time and back side transfer time even at the same environmental temperature, and as a result, the temperature of the adhesion surface between the card K and the transfer film 46 differs, and therefore, such a determination is made. Accordingly, in the case of front side transfer, the preheating amount and the peeling tension for front side transfer are determined (St5), and in the case of back side transfer, the preheating amount and peeling tension for back side transfer are determined (St6). In the present embodiment, in a case where the environmental temperature is high (room temperature or more) even in front side transfer and at the time of back side transfer, it is not necessary to perform preheating treatment, so that the preheating amount is set at "0" (preheating time 0 sec.).

Then, it is determined whether or not the determined preheating amount is "0" (St7), and in a case where the preheating treatment is not required, the card K is caused to wait in a card waiting section including the conveying rollers 29, 30 until the primary transfer processing is finished. When it is determined that the preheating treatment is required, the preheating time and preheating region are loaded from the ROM 71 corresponding to the detected environmental temperature, and the card is conveyed to the preheating position (St8).

In a case where the environmental temperature is a low temperature, preheating is performed only on the card front end, so that it is not necessary to move the card K during the preheating. In the case of extremely low temperature, the preheating region is wide, so that the card K is moved in position within the preheating region and is conveyed back and forth according to need (St9). Subsequently, it is determined whether the preheating time is reached (St10), and when the preheating time is reached, the card K is fed to the transfer start position for secondary transfer processing (St11) to finish the preheating treatment.

Then, it is determined whether or not the primary transfer is finished (St12), and when the primary transfer is finished, the secondary transfer processing is performed (St13). At this time, in peeling the transfer film 46 from the card K that has been subjected to the transfer, peeling is performed by the peeling tension determined in St5 or St6. For feeding of the card K and the transfer film 46 to their cueing positions, it is desirable to perform feeding of the card K after performing feeding of the transfer film 46, and therefore, when the preheating treatment is finished early, feeding of the card K is performed after once performing feeding of the transfer film 46. After the secondary transfer processing, it is determined whether or not back side transfer is required (St14), and when back side transfer is required, the processing flow returns to St6. When transfer is already finished up to the back side transfer or when transfer is performed only on the front side and is finished, the card is discharged (St15), and the card issuance processing is finished.

Figure 7A:
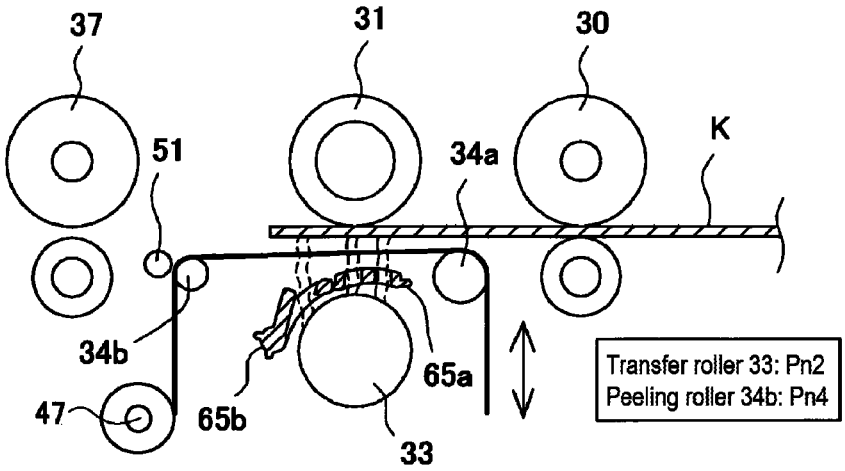
FIGS. 7A to 7C are operation explanatory views from card preheat treatment to the secondary transfer processing.

Herein, operation from the preheating treatment to the secondary transfer processing will be described according to FIGS. 7A to 7C and FIGS. 8A to 8C. FIG. 7A illustrates a state where the card K is preheated during the primary transfer processing. At this time, the transfer roller 33, the peeling roller 34*b*, and the support pin 51 are positioned at the retracted positions (Pn2, Pn4). At this time, an open/close cover 65 of the transfer roller 33 is at the close position; however, openings 65*c* are provided in the open/close cover 65, so that it is possible to transmit heat of the transfer roller 33 to the preheating region of the card K. The transfer film 46 is conveyed back and forth in the primary transfer processing, it does not happen that only a part of the transfer film 46 is excessively heated.

Figure 7B:
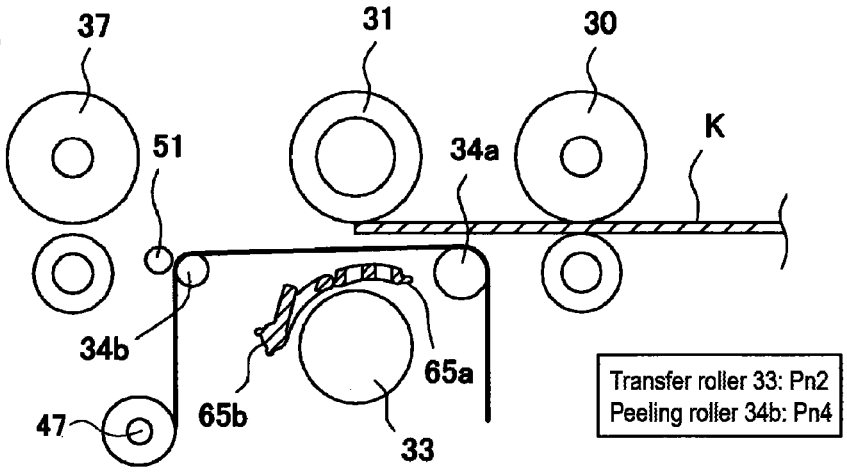

When the primary transfer processing is finished, the transfer film 46 and the card K are respectively fed to start positions of the secondary transfer (FIG. 7B). Also at this time, the transfer roller 33, the peeling roller 34*b*, and the support pin 51 are kept at the retracted positions. Feeding of the transfer film 46 to its cueing position is performed by controlling rotation of the DC motor Mr2 coupled to the supply spool 47, and feeding of the card K to its cueing position is performed by controlling rotation of the card conveying motor SMr (stepping motor) after the card front end passes through the sensor Se3. Since an overrun amount is not certain in halting the DC motor, after first feeding the transfer film 46 to the cueing position, the stepping motor is driven by a distance added with the overrun amount of the DC motor, and feeding of the card K to the cueing position is performed. As a result, the cueing positions of the transfer film 46 and the card K are made correct. The overrun amount of the DC motor Mr2 is detected by an encoder (not illustrated) that detects a rotation amount of the supply spool 47 and is calculated.

Figure 7C:
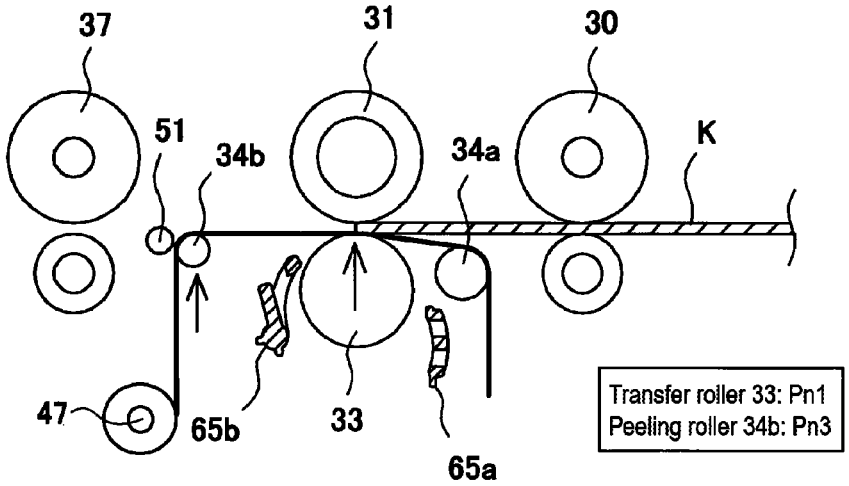

When feeding of the transfer film 46 and the card K to the cueing positions is finished, the control CPU 70 moves the transfer roller 33 from the retracted position (Pn2) to the actuation position (Pn1) and moves the peeling roller 34*b* and the support pin 51 from the retracted position (Pn4) to the actuation position (Pn3). Then, the state of FIG. 7C is made, and the image transfer processing is started. At this time, the conveying amount (conveying speed) of the card K is managed by referring to the card conveying motor SMr (stepping motor).

Figure 8A:
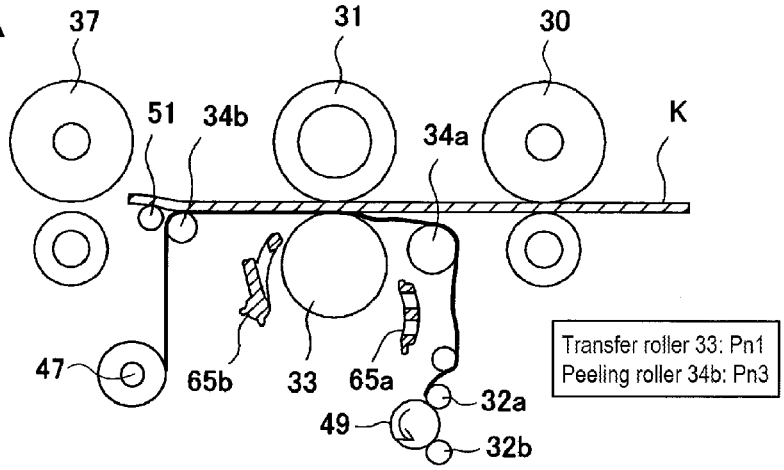
FIGS. 8A to 8C are operation explanatory views related to the secondary transfer processing (continued from FIG. 7C)

With proceeding of the image transfer process, when the front end of the card K arrives at the peeling roller 34*b*, the transfer film 46 is peeled off from the card K. The card front end is acted upon by the force for pulling in the travel direction of the transfer film 46, but is supported by the support pin 51 disposed just behind the peeling roller 34*b*, and therefore, the posture of the card is stable (FIG. 8A). During the image transfer processing, it is necessary to loosen the transfer film 46 on the upstream side relative to the card rear end, the rotation amounts of the card conveying rollers 30, 37, the transfer platen 31 and the carry roller 49 are controlled, and the feed amount of the transfer film 46 is made larger than the conveying amount of the card K so as not to apply the back tension. Since the card front end rushes into the conveying roller pair 37, the transfer film 46 is further loosened. Thus, from this time point, the card conveying speed is increased or reduced so as to eliminate the excessive loosening of the transfer film 46.

Figure 8B:
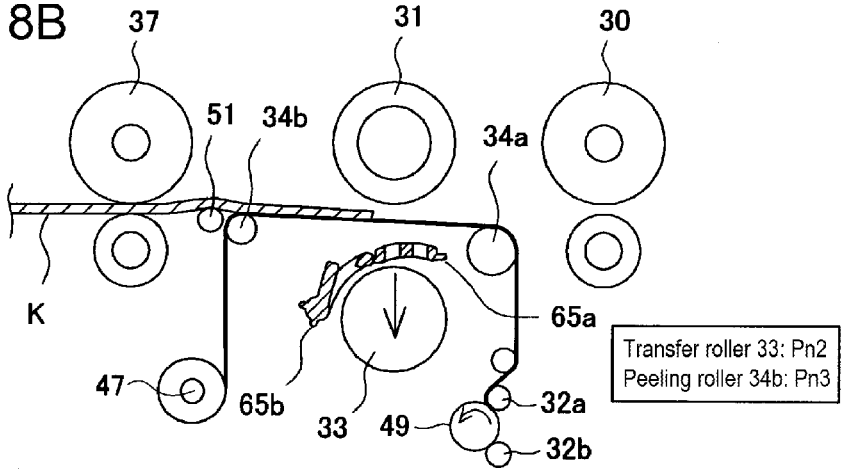

Then, at a timing at which the card rear end passes through the transfer roller 33 (calculated from the number of revolutions of the card conveying motor SMr that drives the conveying roller 30 or beforehand set timer time), the control CPU 70 moves the transfer roller 33 from the actuation position (Pn1) of the state of FIG. 8A to the retracted position (Pn2) of FIG. 8B. At this time, the peeling roller 34*b* and the support pin 51 are held in the actuation state (Pn3) for peeling off the transfer film 46 from the card. At this time, the card rear end is released from the nip of the transfer roller 33 and the transfer platen 31, so that the card K is nipped by only the conveying roller pairs 37 and 38 with a low nip pressure. Thus, the control CPU 70 switches the motor to be referred to for managing the conveying amount to the DC motor Mr2 that drives the supply spool 47. At this time, the transfer film feed amount by the feed roller 49 is reduced to eliminate the loosening of the transfer film 46 until the state of FIG. 8C is made.

Figure 8C:
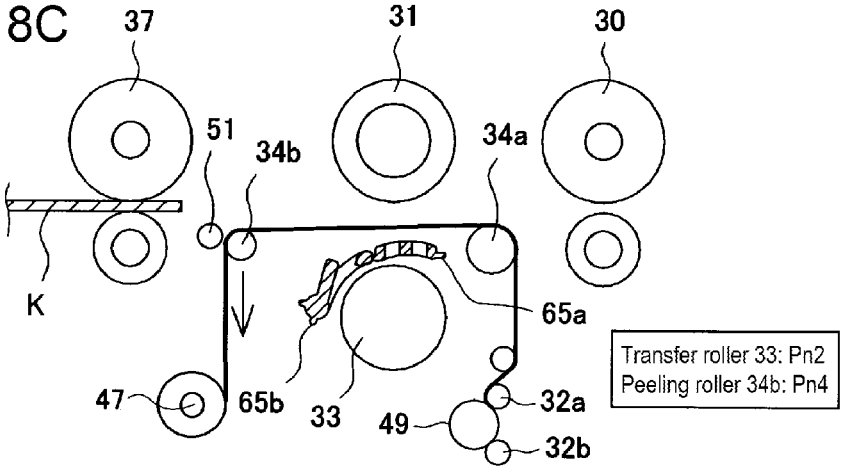

Subsequently, at timing at which the card rear end passes through at least the peeling roller 34*b* (calculated from the diameter information of the supply spool 47 and number of revolutions of the DC motor Mr2 or beforehand set timer time), the control CPU 70 moves once again the peeling roller 34*b* and the support pin 51 from the actuation position (Pn3) to the retracted position (Pn4) (FIG. 8C). At this time, the transfer roller 33 is held in the retracted position (Pn2).

Subsequently, the decurl mechanism 36 corrects curl of the card. In the case of printing on both sides of the card, the card K is conveyed toward the reversing unit F to reverse the card K, and the same transfer processing is applied also to the card back side. In the case of finishing with one-side printing, the card K is directly discharged to the card storage section D. A series of operation is thus finished. In performing the transfer processing on the card back side successively, the card is warmed when the transfer processing is performed on the card front side, so that the preheating treatment is not performed. The card conveying amount at this time is managed once again by referring to the drive amount of the card conveying motor SMr.

Figure 11:
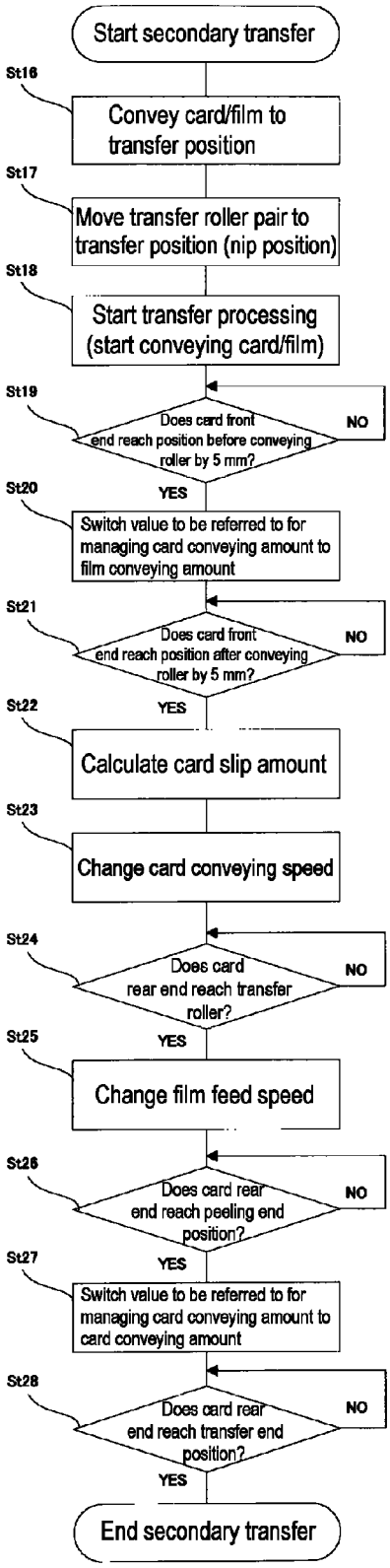
FIG. 11 is a flowchart illustrating a processing flow concerning conveyance of a card and transfer film in the secondary transfer processing.
Figure 12:
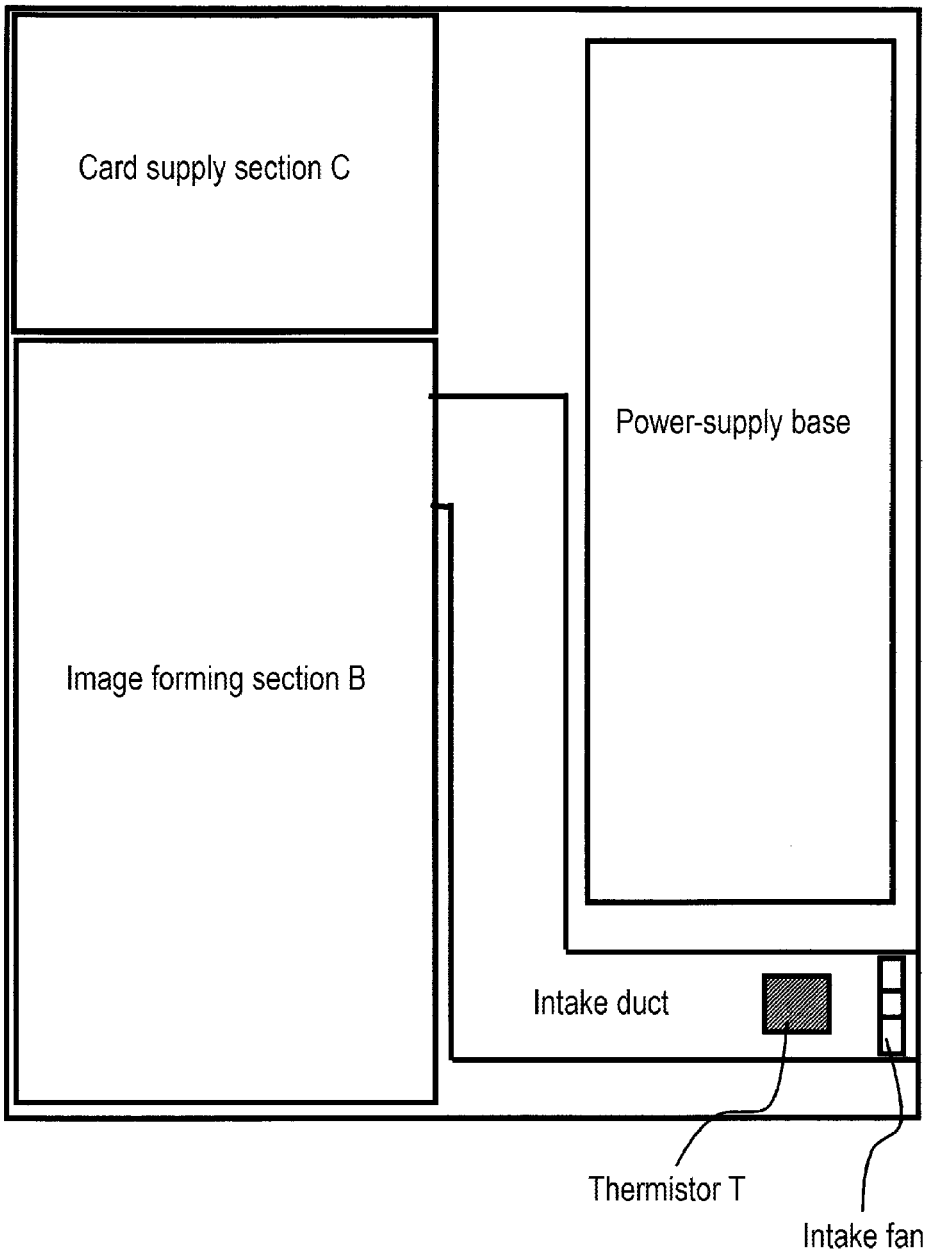
FIG. 12 is a cross-sectional view of the apparatus viewed from the side direction and is a view illustrating a position of a thermistor.

Described herein is a processing flow for conveyance of the card K and the transfer film 46 in the secondary transfer processing (FIG. 11). First, when the secondary transfer processing is started, the CPU 70 starts the card conveying motor SMr (stepping motor) for driving the card conveying rollers 30, 37 and the transfer platen 31, a stepping motor PM for driving the feed roller 49, and the DC motors Mr2 for respectively driving the supply spool 47 and the wind spool 48 to thereby convey the card K and the transfer film 46 to the transfer position (St16). Thereafter, the transfer roller 33 is moved to the transfer position (st17), and the transfer processing is advanced (St18). Then, at a timing when the card front end reaches a position before the conveying roller 37 by 5 mm (St19), the CPU 70 switches the motor to be referred to for managing the conveying amount of the card K to the DC motor Mr2 (St20). Based on the rotation amount of the DC motor Mr2 and diameter information of the supply spool 47, the CPU 70 detects that the front end of the card K has advanced by 5 mm after reaching the conveying roller 37 (St21). At this time point, the CPU 70 compares the rotation amount of the card conveying motor SMr after start of the transfer processing and conveying amount of the transfer film 46 (rotation amount of the supply spool 47) to thereby detect a slip amount of the card K when the card front end rushes into the conveying roller pair 37 (St22). Up to this time point, the conveying speed of the card K is 25 mm/s, and the transfer film feed speed by the feed roller is 25.5 mm/s. The calculation reveals that the transfer film 46 at the upstream side relative to the transfer roller 33 in the transfer direction is loosened by 2 mm; actually, the transfer film 46 is additionally loosened by 1 mm due to slippage of the card K (i.e., loosened by 3 mm in total).

During a time until the card rear end passes through the transfer roller 33, it is necessary to eliminate the excessive loosening (detected slip amount) (1 mm) of the transfer film 46, so that the CPU 70 controls the DC motor Mr2 such that the conveying speed of the card K becomes 25.36 mm/s (feed speed of the transfer film 46 is not changed) (St23). Thereafter, until the card rear end reaches the transfer roller 33, the card K and transfer film 46 are conveyed at the above speeds, respectively. Then, when the card rear end reaches the transfer roller 33 (St24), the CPU 70 controls the stepping motor PM for driving the feed roller 49 such that the feed amount of the transfer film 46 becomes 23.4 mm/s (St25). This eliminates the loosening of the transfer film 46 formed during the transfer processing until the card rear end reaches the peeling roller 34*b*. Thereafter, when the card rear end reaches the peeling roller 34*b* (St26), the CPU 70 switches the motor to be referred to for managing the conveying amount of the card K to the card conveying motor SMr (St27). Then, when the card rear end reaches an end position of the transfer processing (St28), the transfer processing is ended.

The slip amount of the card K is calculated as follows. A moving distance of the card K from a time when the transfer processing is started to a time when the card front end advances by 5 mm after reaching the conveying roller 37 is 49.7 mm. The CPU 70 determines that the card K has advanced by 49.7 mm when the number of rotations of the card conveying motor SMr generates 1775 clocks. The CPU 70 calculates the actual conveying amount of the transfer film 46 from the number of clocks (193 clocks) of the encoder mounted to the shaft of the DC motor Mr2 at that time and diameter (diameter is calculated from the number of clocks obtained when the transfer film 46 is transferred by a predetermined amount in the previous transfer processing) information of the supply spool 47. Assuming that the calculation result is 48.7 mm, the CPU determines that the card K has slipped by 1 mm. If it is detected that the card K has slipped by 2 mm, the CPU 70 increases the conveying speed of the card K or reduces the feed speed of the transfer film 46 in St23 so as to eliminate the loosening of the transfer film 46 corresponding to the slip amount.

<Effects and Others>

In the transfer device according to the present embodiment, the slip amount of the card K generated when the card K rushes into the conveying roller pair 37 is detected, and the card conveying speed is increased by the detected slip amount relative to the feed speed of the transfer film 46 by the feed roller 49, whereby the transfer film 46 is not loosened excessively on the card rear end side (transfer direction upstream side relative to the transfer roller). This prevents the transfer film 46 from wrinkling at the time of the transfer processing to thereby improve transfer quality. Further, if the transfer film 46 is loosened when the transfer film 46 is peeled off from the card rear end, the transfer film may fail to be fully peeled off the card K at an estimated transfer end position (position at which the peeling is finished); however, in the transfer device according to the present embodiment, the card conveying speed and transfer film feed speed are controlled so as to eliminate the loosening of the transfer film 46 on the card rear end at the transfer end time and, thus, peeling quality is also improved.

Further, in the transfer device according to the present embodiment, the conveying amount of the card K is counted based on the drive amount of the card conveying motor SMr during a time from when the transfer processing for the card K is started to when the card K is conveyed by a predetermined amount, and switching is carried out before the end of the transfer processing such the conveying amount of the card K is counted based on the drive amount of the DC motor Mr2 for winding up the transfer film during the transfer processing. Thus, even when a slippage (idle rotation) of the conveying roller pair 37 with respect to the card K occurs after the card rear end passes through the transfer roller 33, a difference between the estimated card conveying amount and actual conveying amount is small. Thus, it is possible to prevent a problem that the card rear end does not reach the peeling roller 34*b* at the estimated transfer end position.

In the present embodiment, to detect the slip amount of the card K, the drive amount of the card conveying motor SMr and conveying amount of the transfer film 46 at the downstream side of the transfer roller 33 are compared. Alternatively, however, the drive amount of the stepping motor PM for driving the feed roller 49 and conveying amount of the transfer film 46 at the downstream side of the transfer roller 33 may be compared. Further, in the present embodiment, the rotation amount of the supply spool 47 at the downstream side in the transfer direction, which is calculated based on the rotation amount of the DC motor Mr2 and diameter information of the supply spool 47, is used to calculate the conveying amount of the transfer film 46. Alternatively, however, when a transfer film conveying member like the feed roller 49 is provided between the peeling roller 34*b* and the supply spool 47, the conveying amount of the transfer film 46 can be calculated by detecting a rotation amount of the transfer film conveying member.

Further, in the present embodiment, the card conveying amount is calculated by counting the drive amount of the card conveying motor SMr (stepping motor) that drives the conveying rollers 29, 30, 37, and 38 and transfer platen 31 after the card front end passes through the sensor Se3; alternatively, however, the card conveying amount may be calculated not based on the motor drive amount, but by mounting an encoder to the shaft of the conveying roller and detecting the number of clocks of the encoder. Similarly, the conveying amount of the transfer film 46 may also be calculated not based on the drive amount of the DC motor Mr2, but by mounting an encoder to the shaft of the supply spool 47 and detecting the number of clocks of the encoder, and the calculated conveying amount of the transfer film 46 may be replaced by the card conveying amount.

Further, in the present embodiment, the card conveying speed is increased in St23, and the feed speed of the transfer film 46 is reduced at St25. Alternatively, however, a configuration may be adopted in which the feed speed of the transfer film 46 is reduced at St23, and card conveying speed is increased in St25, and a combination thereof may be employed.

Further, in the present embodiment, the transfer film feed amount by the feed roller 49 is increased during the transfer processing to loosen the transfer film 46 so as not to apply the back tension. Alternatively, however, even when the transfer processing is performed with the back tension applied (with the transfer film 46 stretched), the slippage of the card K is detected, and the card conveying speed is increased and/or transfer film feed speed is reduced so as to eliminate the loosening of the transfer film 46 caused due to the slippage, whereby desired effect can be obtained.

This application is based upon and claims the benefit of priority from the Japanese Patent Application No 2014-266142, the entire content of which is incorporated herein by reference.

What is claimed is:

1. A transfer device that transfers, on a recording medium, an image on a transfer film which is formed by pressure contact between a heating member and a transfer platen through the transfer film, comprising:

an image transfer section having the heating member and the transfer platen, in which the heating member and the transfer platen are configured to be movable between an actuation position at which they are brought into pressure-contact with each other and a retracted position at which they are separated from each other;

a plurality of recording medium conveyors that convey the recording medium;

a first detector that detects a drive amount of one of the recording medium conveyors during the transfer processing;

a transfer film feeder that feeds, during the image transfer, the transfer film on an upstream side relative to the heating member in a transfer film conveying direction;

a transfer film conveyor that feeds, during the image transfer, the transfer film on a downstream side relative to the heating member in a transfer film conveying direction;

a second detector that detects a transfer film conveying amount by the transfer film conveyor during the transfer processing; and a controller that controls the image transfer section, the recording medium conveyors, the transfer film feeder, and the transfer film conveyor, wherein at least one of the recording medium conveyors is provided downstream of the heating member in the transfer direction, and after a front end of the recording medium reaches the recording medium conveyor provided downstream of the heating member, the controller increases the conveying amount of the recording medium and/or reduces the transfer film feed amount in accordance with detection results of the first and second detectors.

2. The transfer device according to claim 1, further comprising, between the heating member and the recording medium conveyor downstream of the heating member, a peeling member that peels the transfer film from the recording medium, wherein after the front end of the recording medium reaches the recording medium conveyor downstream of the heating member, the first and second detectors detect the drive amount of the recording medium conveyor and the conveying amount of the transfer film, respectively, before the front end of the recording medium reaches the recording medium conveyor downstream of the heating member, and the controller increases the conveying amount of the recording medium and/or reduces the transfer film feed amount, during a time after the first and second detectors detect the drive amount of the recording medium conveyor and conveying amount of the transfer film, respectively, and before a rear end of the recording medium reaches the peeling member, in accordance with the detection results of the first and second detectors.

3. The transfer device according to claim 1, wherein the controller makes the transfer film feed amount larger than the conveying amount of the recording medium during a time from when the transfer processing is started to when the front end of the recording medium reaches the recording medium conveyor downstream of the heating member.

4. The transfer device according to claim 3, further comprising a third detector that detects a transfer film feed amount by the transfer film feeder during the transfer processing, wherein the controller increases the conveying amount of the recording medium and/or reduces the transfer film feed amount in accordance with detection results of the first, second, and third detectors during a time after the front end of the recording medium reaches the recording medium conveyor downstream of the heating member and before the rear end of the recording medium reaches the peeling member.

5. The transfer device according to claim 1, wherein the recording medium conveyors are driven by a stepping motor, and the transfer film conveyor is driven by a DC motor.

6. A transfer device that transfers, on a recording medium, an image on a transfer film which is formed by pressure contact between a heating member and a transfer platen through the transfer film, comprising:

an image transfer section having the heating member and the transfer platen, in which the heating member and the transfer platen are configured to be movable between an actuation position at which they are brought into pressure-contact with each other and a retracted position at which they are separated from each other;

a plurality of recording medium conveyors that convey the recording medium;

a transfer film feeder that feeds, during the image transfer, the transfer film on an upstream side relative to the heating member in a transfer film conveying direction;

a film feed amount detector that detects a transfer film feed amount by the transfer film feeder during the transfer processing;

a transfer film conveyor that feeds, during the image transfer, the transfer film on a downstream side relative to the heating member in a transfer film conveying direction;

a film conveying amount detector that detects a transfer film conveying amount by the transfer film conveyor during the transfer processing; and a controller that controls the image transfer section, the recording medium conveyor, the transfer film feeder, and the transfer film conveyor, wherein at least one of the recording medium conveyors is provided downstream of the heating member in the transfer direction, and after a front end of the recording medium reaches the recording medium conveyor provided downstream of the heating member, the controller increases the conveying amount of the recording medium and/or reduces the transfer film feed amount in accordance with detection results of the film feed amount detector and the film conveying amount detector.

7. The transfer device according to claim 6, further comprising, between the heating member and the recording medium conveyor downstream of the heating member, a peeling member that peels the transfer film from the recording medium, wherein after the front end of the recording medium reaches the recording medium conveyor downstream of the heating member, the film feed amount detector and the film conveying amount detector detect the transfer film feed amount and the transfer film conveying amount, respectively, before the front end of the recording medium reaches the recording medium conveyor downstream of the heating member, and the controller increases the conveying amount of the recording medium and/or reduces the transfer film feed amount, during a time after the film feed amount detector and the film conveying amount detector detect the transfer film feed amount and the transfer film conveying amount, respectively, and before a rear end of the recording medium reaches the peeling member, in accordance with the detection results of the film feed amount detector and the film conveying amount detector.

* * * * *